US009881469B2

(12) United States Patent
Guerzoni

(10) Patent No.: US 9,881,469 B2
(45) Date of Patent: Jan. 30, 2018

(54) DEVICE, SYSTEM AND METHOD FOR MONITORING A PREDETERMINED SPACE

(71) Applicants: Filippo Guerzoni, Modena (IT); Cesare Micheli, Parma (IT)

(72) Inventor: Filippo Guerzoni, Modena (IT)

(73) Assignees: Filippo Guerzoni, Modena (IT); Cesare Micheli, Parma (IT)

( * ) Notice: Subject to any disclaimer, the term of this patent is extended or adjusted under 35 U.S.C. 154(b) by 0 days.

(21) Appl. No.: 14/404,305

(22) PCT Filed: May 27, 2013

(86) PCT No.: PCT/IB2013/054360

§ 371 (c)(1),
(2) Date: Nov. 26, 2014

(87) PCT Pub. No.: WO2013/179201

PCT Pub. Date: Dec. 5, 2013

(65) Prior Publication Data

US 2015/0187191 A1 Jul. 2, 2015

(30) Foreign Application Priority Data

May 31, 2012 (IT) ..... BO2012A0299

(51) Int. Cl.
*G08B 13/00* (2006.01)
*G08B 13/19* (2006.01)

(52) U.S. Cl.
CPC ..... *G08B 13/00* (2013.01); *G08B 13/19* (2013.01)

(58) Field of Classification Search
CPC ..... G08B 13/00; G08B 13/19
USPC ..... 340/540, 541
See application file for complete search history.

(56) References Cited

U.S. PATENT DOCUMENTS 8,909,382 B1 * 12/2014 Malakuti ..... G08B 13/00 315/131
2006/0250237 A1 11/2006 Whitten
2009/0201190 A1 * 8/2009 Huthoefer ..... G01S 7/003 342/27
2009/0262189 A1 * 10/2009 Marman ..... G08B 13/19613 348/143

(Continued)

FOREIGN PATENT DOCUMENTS

CA 2634261 12/2008
WO 2006093527 9/2006

(Continued)

OTHER PUBLICATIONS

International Search Report and Written Opinion of the International Searching Authority dated Aug. 28, 2013 for counterpart PCT Application No. PCT/IB2013/054360.

*Primary Examiner* — Omar Casillashernandez
(74) *Attorney, Agent, or Firm* — Shuttleworth & Ingersoll, PLC; Timothy J. Klima

(57) ABSTRACT

A method for monitoring a predetermined space, comprising the following steps:
a) preparing at least one first volumetric sensor for detecting a first movement signal representative of movement in an authorized zone of said space;
b) preparing at least one second volumetric sensor for detecting a second movement signal representative of movement in an unauthorized zone of said space;
c) processing said first signal and second signal for identifying a movement in said space.

12 Claims, 6 Drawing Sheets

(56) References Cited

U.S. PATENT DOCUMENTS

| | | | | |
|---|---|---|---|---|
| 2010/0090829 | A1* | 4/2010 | Pujol | G08B 13/1965 340/541 |
| 2012/0106782 | A1* | 5/2012 | Nathan | G06K 9/00771 382/103 |
| 2013/0015355 | A1* | 1/2013 | Noone | G07C 9/00 250/340 |
| 2013/0076866 | A1* | 3/2013 | Drinkard | H04N 7/181 348/47 |
| 2014/0091936 | A1* | 4/2014 | O'Reilly | H05B 37/0227 340/669 |

FOREIGN PATENT DOCUMENTS

| | | | | |
|---|---|---|---|---|
| WO | WO 2006093527 | A2 * | 9/2006 | G08B 13/196 |
| WO | 2011005074 | | 1/2011 | |

* cited by examiner

DEVICE, SYSTEM AND METHOD FOR MONITORING A PREDETERMINED SPACE

This application is the National Phase of International Application PCT/IB2013/054360 filed May 27, 2013 which designated the U.S. and that International Application was published under PCT Article 21(2) in English.

This application claims priority to Italian Patent Application No. BO2012A000299 filed May 31, 2012, which application is incorporated by reference herein.

TECHNICAL FIELD

This invention relates to a device, a system and a method for monitoring a predetermined space, that is, a monitoring area (both inside and outside of buildings).

BACKGROUND ART

Volumetric type monitoring systems are known in the sector in question which allow predetermined zones to be monitored.

These monitoring systems are generally equipped with volumetric sensors which allow the accesses to the building (for example, the doors, windows etc.) to be monitored.

A first drawback of this type of security/monitoring system is due to the fact that these systems do not distinguish whether the person accessing the monitored space is authorised or not to access the space.

This means that these volumetric detection systems can only be activated in the absence of persons in the protected area and they must therefore be deactivated if that is not the case.

A drawback of these systems is that they must be kept deactivated when persons are present inside the zone being monitored: in that case, any access of unauthorised persons (malicious or otherwise) cannot be detected.

There has therefore been a long felt need for the provision of a volumetric type security/monitoring system which can be kept operational also in the presence of persons in the predetermined zone, thus guaranteeing a greater security for the occupants of the zone.

DISCLOSURE OF THE INVENTION

The aim of the present invention is, therefore, to overcome these drawbacks by providing a device and a system for monitoring a predetermined space (both inside and outside a building).

Another aim is to provide a process for monitoring a predetermined space comprising a first and a second zone.

According to the invention, this aim is achieved by a device, a system and a method comprising the technical features described herein.

BRIEF DESCRIPTION OF THE DRAWINGS

The technical characteristics of the invention, with reference to the above aims, are clearly described in the claims below and its advantages are apparent from the detailed description which follows, with reference to the accompanying drawings which illustrate a preferred embodiment of the invention provided merely by way of example without restricting the scope of the inventive concept, and in which:

DETAILED DESCRIPTION OF THE PREFERRED EMBODIMENTS OF THE INVENTION

With reference to the accompanying drawings, the invention comprises a device 1 for monitoring a predetermined zone or space V (these two terms are used below without distinction).

The predetermined space V, in the example shown in the accompanying figures, comprises a first "authorised" zone 3A and a second "unauthorised" zone 2NA.

Figure 1:
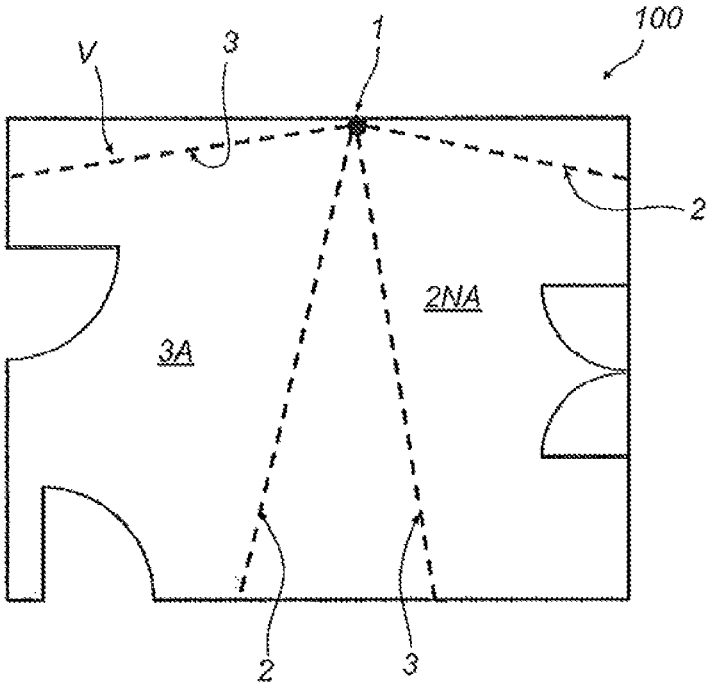
FIG. 1 shows an application example of the monitoring device and system according to this invention.

In the example shown in FIG. 1 the first zone 3A is delimited by the dashed lines labelled 3, whilst the second zone 2NA is delimited by the dashed lines labelled 2.

The first zone 3A will hereafter also be referred to as "authorised". Whilst the second zone 2NA will hereafter also be referred to as "unauthorised".

The monitoring device 1, in the simplest embodiment, comprises a first volumetric sensor SV1 for detecting a first movement signal S1 in the first zone 3A of the space.

It should be noted that the first zone 2A is the zone monitored by the first sensor SV1: in other words, by changing the orientation/positioning of the first sensor S1 the boundaries of the first zone are modified.

Moreover, the device 1 in its simplest embodiment comprises a second volumetric sensor SV2 for detecting a second movement signal S2 in a second zone 2NA of the monitored space.

It should be noted that the second zone 2NA is the zone monitored by the second sensor SV2: in other words, by changing the orientation/positioning of the second sensor SV2 the boundaries of the second zone are modified.

It should be noted that, more generally speaking, the device 1 can also comprise more than two sensors.

In that case, each sensor can be designed for monitoring a zone of the authorised type or a zone of the unauthorised type.

The sensors SV1, SV2 are volumetric type sensors.

Preferably, the sensors SV1, SV2 are passive infra-red (PIR) sensors.

As an alternative to the PIR sensors, any type of volumetric sensor can be used, such as, for example, microwave or ultrasound sensors, or combinations of them.

It should be noted that the use of technologically different sensors allows the degree of protection to be further increased: in effect, if technologically different sensors are used to monitor unauthorised spaces, it is more difficult for an unauthorised person to avoid detection of the movement by both the sensors.

Yet more preferably, the sensors SV1, SV2 comprise optics O1, O2 of the mirror type, that is, optical cones.

The choice of these optics O1, O2 advantageously allows the general dimensions of the device 1 to be reduced and the supports of the sensors SV1, SV2 to be simplified whilst maintaining a certain possibility of adjustment of the orientation of the sensors SV1, SV2.

The type of optics O1, O2 also allows the flexibility of the device 1 to be increased as it allows the degree of overlapping of the spaces monitored by the sensors SV1, SV2 to be modified and to adapt the configuration of the device 1 to every type of environment.

However, it should be noted that it is also possible to use fixed or mobile optics, preferably based on Fresnel lenses.

It should be noted that the sensors (SV1, SV2) can also not be provided with optics; the optics are preferably present in the case of PIR type sensors.

Preferably, the sensors (SV1, SV2) ere associated with an adjustable support, to allow adjustment of the position.

Yet more preferably, each sensor (SV1, SV2) is connected to the circuit C by electrical connecting means.

It should be noted that the sensors SV1, SV2 can provide an analogue or digital signal (S1, S2) to the processing means (which are described below) (that is, the sensors SV1, SV2 can be of the analogue or digital type).

If the signal S1, S2 is analogue, it is possible, so as to prevent potential electromagnetic disturbances from altering the levels of the signal S1, S2, to amplify the signal using an amplification circuit located in the support of the sensor SV1, SV2 and close to the sensor; or, alternatively, it is possible to use a piece of shielded cable.

If the sensors SV1, SV2 are of the digital type, the amplifier is preferably directly integrated in the sensor SV1, SV2.

It should be noted that the device 1 comprises means of processing the signals S1, S2 of the sensors.

Figure 4:
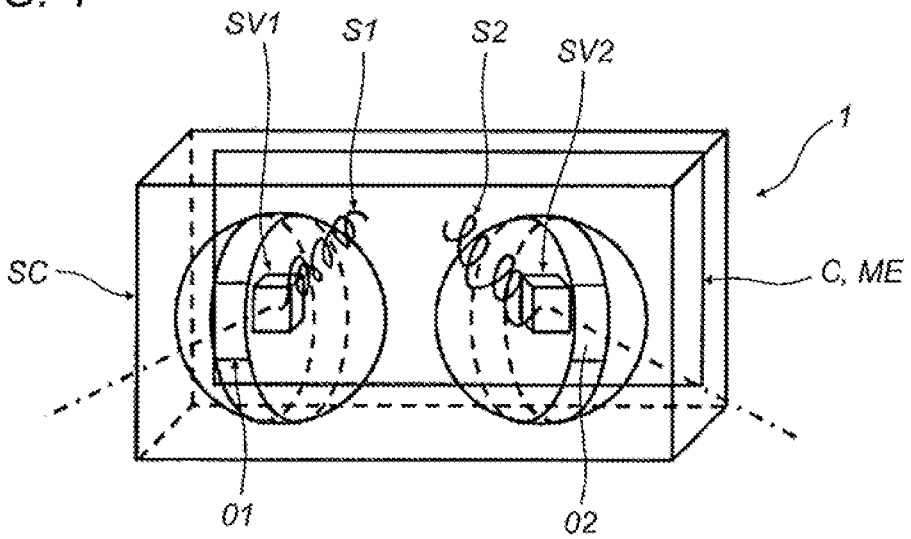
FIG. 4 shows a preferred embodiment of the monitoring device according to this invention.

Preferably, in the preferred embodiment, the sensors SV1, SV2 and the processing means are integrated inside the same box-shaped container SC (clearly shown in FIG. 4).

The processing means ME are designed for implementing the method/algorithm shown in FIG. 5 and described below.

It should be noted that, advantageously, the sensors SV1, SV2 can be fixed to a masonry structure (vertical or horizontal wall) or to any other structure.

Figure 5:
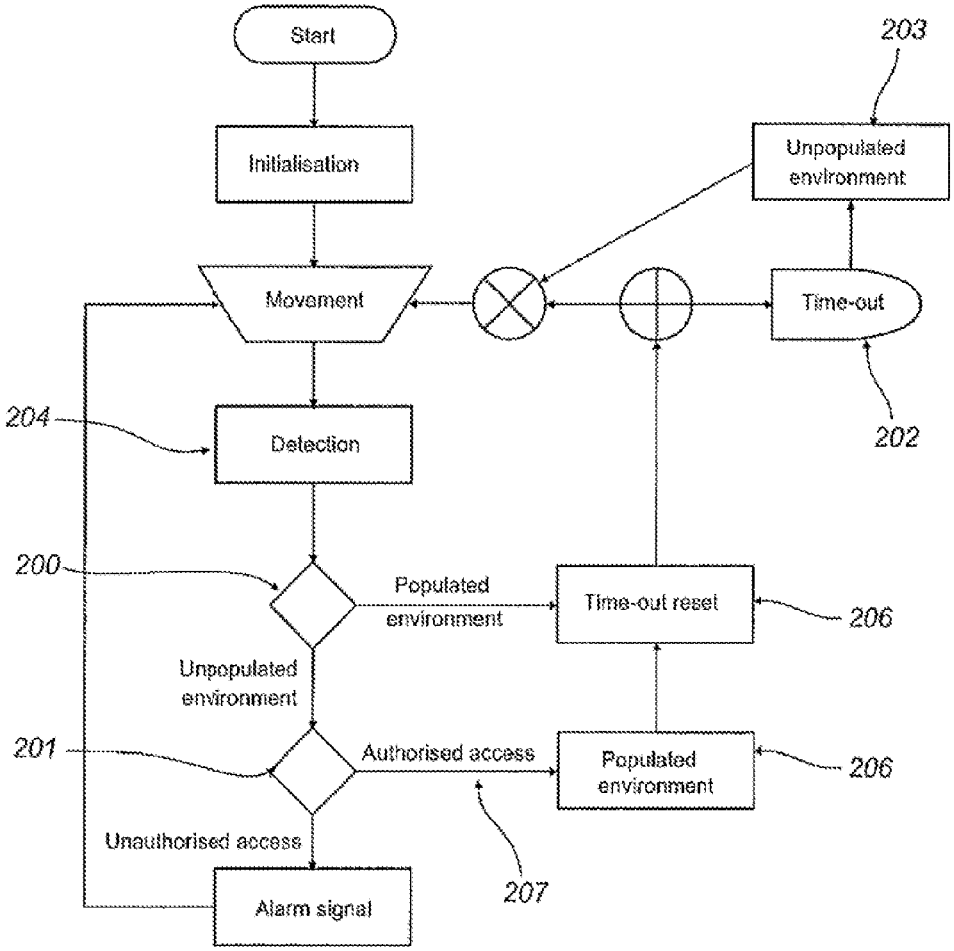
FIG. 5 shows a flow chart of a preferred operating mode of the monitoring device according to this invention.

Described below is the flow chart of FIG. 5, representing a preferred mode of implementing the method according to the invention and related to the case of using a single device 1.

The monitoring method comprises a first step of starting the device 1.

The initialisation step, which follows in time the starting of the device 1, allows determination of whether the space in which the device 1 is installed is "populated" or "unpopulated".

It should be noted that the initialisation step is normally performed following replacement of batteries or switching OFF of the device 1: this step is therefore generally not very frequent.

During the initialisation step, the status of the zone monitored is set as "populated" or "unpopulated" as a function of the value of the movement signals coming from the sensors SV1, SV2.

It should be noted that in this initialisation step the status of the monitored zone is preferably set as:

"populated" if the sensors SV1, SV2 detect a movement in the monitored zone for a predetermined time;

"unpopulated" if no movement is detected in the monitored zone for a predetermined time.

After completing the initialisation step, that is, the normal operation of the device 1, the signals S1, S2 of both the sensors SV1, SV2 are analysed for detecting a movement inside the monitored zone ("detection" block).

Preferably, each signal S1, S2 is analysed without distinguishing the source of the movement; in other words, the signals S1, S2 are analysed for identifying a movement inside the monitored zone.

After detection of the movement by one of the two sensors SV1, SV2 or by both, the method comprises (block 200), as a function of the value of the status variable of the zone monitored, that is, "populated" or "unpopulated", performance of two different steps: a first step (time-out reset block) and a second step (block 201).

Below is a description firstly of the first step (time-out reset block) and then of the second step (block 201).

It should be noted that if the status variable has a "populated" value, a time-out time is set to zero, that is, a countdown of a predetermined duration is activated.

The countdown duration can be programmed (for example, preferably of the order of magnitude of minutes).

It should be noted that, after the zeroing of the time-out, that is, the starting of the countdown, two different situations/events can occur.

A first situation is relative to the movement of a person inside the monitored zone during execution of the countdown (that is, before the countdown has reached the zero value).

If a further movement is detected (where the term "further" means a movement after that which caused the time-out reset) by the sensors SV1 and SV2, the method evaluates the value of the status variable of the zone monitored (block 200).

A second situation is that in which the sensors SV1, SV2 have not detected any movement inside the zone monitored for the entire duration of the countdown.

This situation can correspond to that in which a person has stopped still, that is, has stopped the relative movement inside the zone monitored.

At the end of the countdown (block 202) the status variable of the monitored zone is set to the "unpopulated" value (block 203).

With reference to the above-mentioned second step, that is, the step which is activated if the status variable has an "unpopulated" value at block 200, there is a step for evaluating whether the movement detected at block 204 has been detected in the authorised zone or in the unauthorised zone.

If the movement has been detected in the second unauthorised zone, the device 1 provides an alarm signal: in other words, the device signals an alarm.

This situation, in the case of an environment inside a building, can potentially correspond to an entrance of a person from doors, windows, etc. which are present in the unauthorised zone.

On the other hand, if the movement has been detected in the first authorised zone, the status variable is set to the "populated" value (block 205): this situation, in the case of an environment inside a building, can potentially correspond to an entrance of a person from doors which are present in the authorised zone: in other words, this can correspond to an entrance in the authorised zone from internal doors.

After setting the status variable to the "populated" value (block 205), the time-out is reset (block 206), implementing the sequence of operations described above.

The following should be noted with regard to the time-out.

The time-out, that is, the countdown, allows the "authorised" persons who stop exclusively in the unauthorised spaces for a time less than the duration of the countdown to not trip the alarm signal when they move again, that is, when the device detects movement again.

Figure 6:
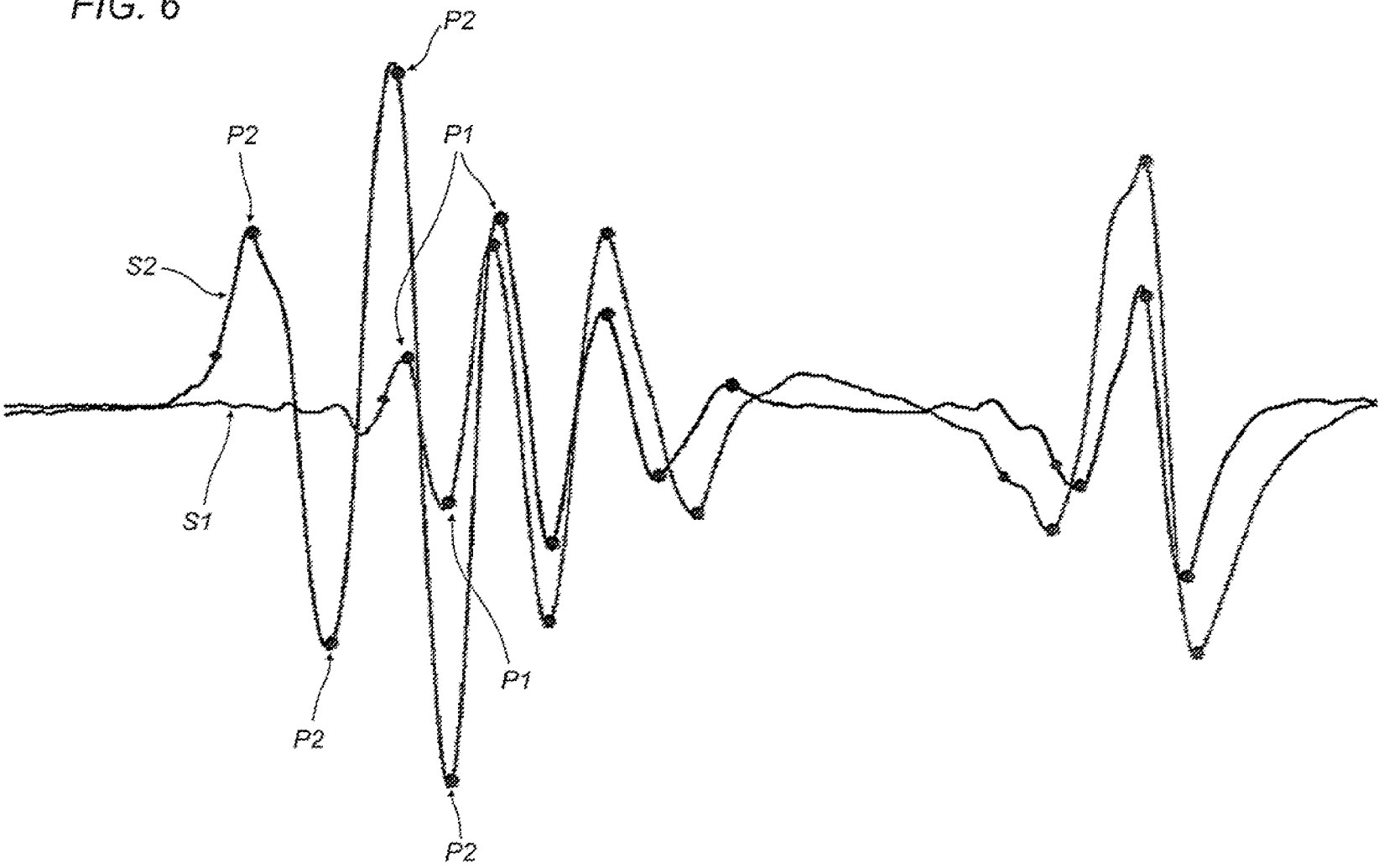
FIG. 6 shows an example of movement signals corresponding to a first situation.
Figure 7:
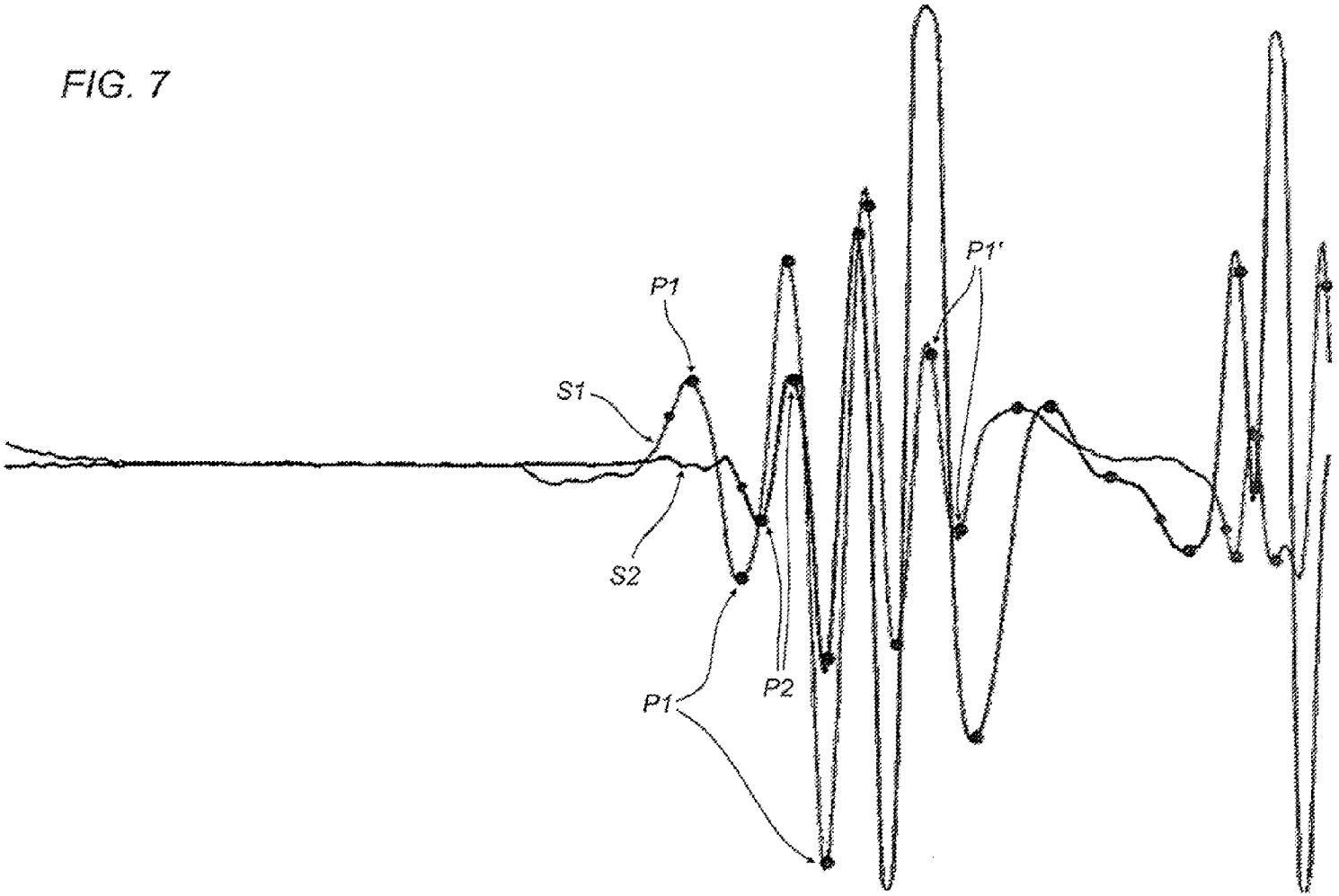
FIG. 7 shows an example of movement signal corresponding to a second situation.
Figure 8:
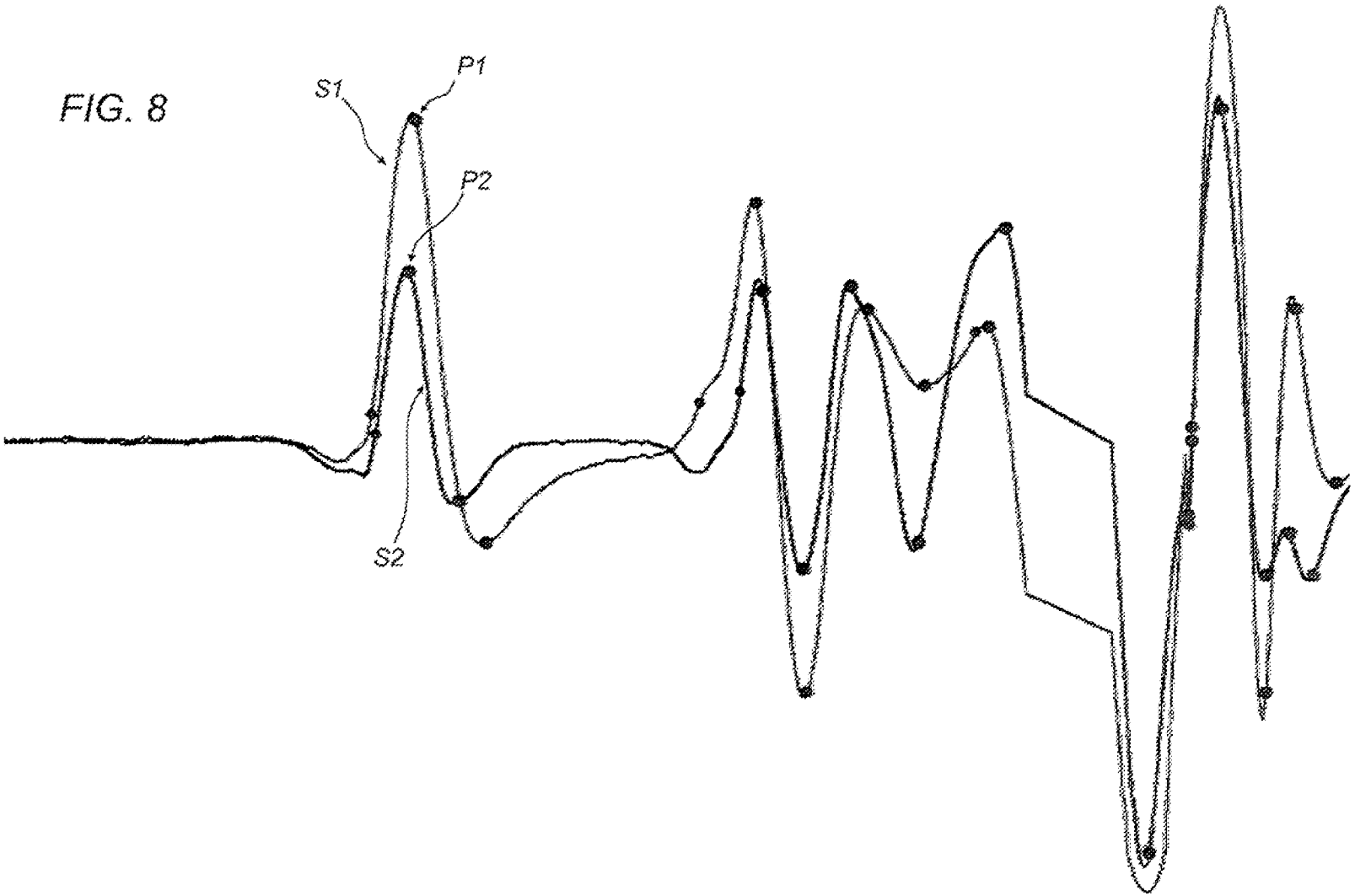
FIG. 8 shows a further example of movement signals corresponding to a third situation.

With regard to the step for detecting movement (block 204), it should be noted that FIGS. 6 to 8 show the waveforms of the signals S1, S2 of the first sensor SV1 and of the second sensor SV2.

FIG. 6 in particular shows the case of a person who makes a movement in the unauthorised space (which is detected by the corresponding second sensor SV2) and then a movement in the authorised space (which is detected by the corresponding first sensor SV1).

This type of movement is evident observing the two signals S1, S2, which correspond, respectively, to the first signal S1 of the first sensor SV1 and to the second signal S2 of the second sensor SV2: the second signal S2 has peaks P2, corresponding to the movement in the unauthorised zone, in a moment in time before the peaks P1 of the first signal S1, corresponding to the movement in the authorised zone.

It should also be noted that, according to the sequence of operational steps of the method described above, the signals S1, S2 with this waveform cause an alarm signal.

FIG. 7 in particular shows the case of a person who makes a movement in the authorised space and then a movement in the unauthorised and authorised space.

This is evident observing the two signals S1, S2, which correspond, respectively, to the first signal S1 of the first sensor SV1 and to the second signal S2 of the second sensor SV2: the first signal S1 has peaks P1, corresponding to the movement, in a moment in time before those of the second signal and, subsequently, there are peaks P1', P2 of both the signals (P1' of the first signal and P2 of the second signal).

The person who generated these signals S1, S2 moves first in the authorised space and then both in the unauthorised space and in the authorised space.

In this situation, the device 1 does not provide the alarm signal as the movement started in the authorised space.

FIG. 8 in particular shows the case in which the movement is detected simultaneously by both the sensors.

In this case, the movement is considered authorised.

It should be noted that, in general, more than one device 1 can be used connected to a control (or central) unit for forming a monitoring system 100.

Figure 2:
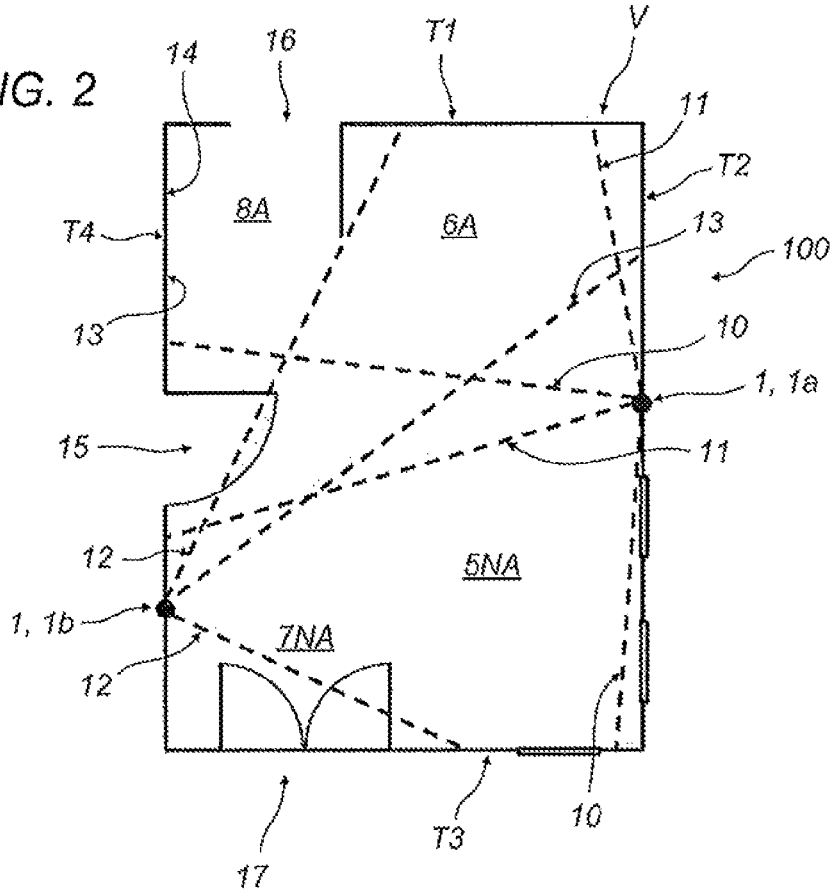
FIG. 2 shows a further application example of the monitoring device and system according to this invention.

More specifically, FIG. 2 shows an example in which there are two devices (1*a*, 1*b*) which guarantee the protection of an environment (room inside a building) identified by four walls (T1, T2, T3, T4) and having a more complex type than the environment of FIG. 1.

One (1*a*) of the two devices 1*a*, 1*b* detects the movement in the spaces having the edges labelled 10 and 11.

The space 5NA having as edges the lines labelled 10 is the space—of the first device 1*a*—which is unauthorised whilst the space 6A having as edges the lines labelled 11 is the space—of the first device 1*a*—which is authorised.

The device 1*b* detects the movement in the spaces having as edges 12 and 13.

The space 7NA having as edges 12 is the unauthorised space of the second device 1*b* whilst the space 8A having as edges 13 is the authorised space of the second device 1*b*.

One of the sides of the space 8A coincides, in this case, with an inner surface 14 of the wall T4.

The control unit (not illustrated) keeps the devices (1*a*, 1*b*) synchronised for providing the correct time sequence of the events transmitted by the devices (1*a*, 1*b*).

Described below are certain situations relative to the example of FIG. 2, to clarify better the operation of the device 1.

FIG. 2 shows an example in which a person who enters the room from the internal door 16 generates, simultaneously, a movement detected in the authorised space 6A of the device 1*a* and in the authorised space 8A of the device 1*b*.

The access is therefore authorised (block 207 of the algorithm shown in FIG. 5) and does not cause any alarm signal.

A person who enters the room from the internal door 15 generates a movement detected simultaneously in the rooms 6A, 8A and 5NA.

Also in this case, due to the simultaneous nature of the events, the access is considered authorised.

A person who enters from the external door 17 generates a movement in the unauthorised space 5NA of the device 1*a* and, depending on the proximity to the device 1*b*, an unauthorised movement in the space 7NA.

The presence of two (1*a*, 1*b*) or more devices in general guarantees the best possible coverage of the room in question.

It should be noted that, advantageously, the use of two devices which act in conjunction to guarantee the best possible coverage of the environment avoids any problems linked to the possibility that the movement can take place beneath one of the devices.

The control unit is connected to each device for receiving an alarm signal and is designed to activate an alarm depending on the values of the alarm signals.

The control unit can be designed to activate the alarm depending on the values of the alarm signals according to various operating logics: AND, OR, etc.

Preferably, the control unit is designed with AND mode.

Moreover, the control unit is connected to alarm means, preferably comprising audio or visual signalling means (not illustrated), which can be activated by the control unit as a function of the value of the alarm signals, to release an alarm signal (preferably of the audio or visual type).

According to another aspect, the alarm means comprise transmission means designed for sending a remote alarm signal (for example, by an SMS, phone call).

Yet more preferably, the transmission means comprise a module designed for connecting to a mobile phone and sending a remote alarm signal.

Figure 3:
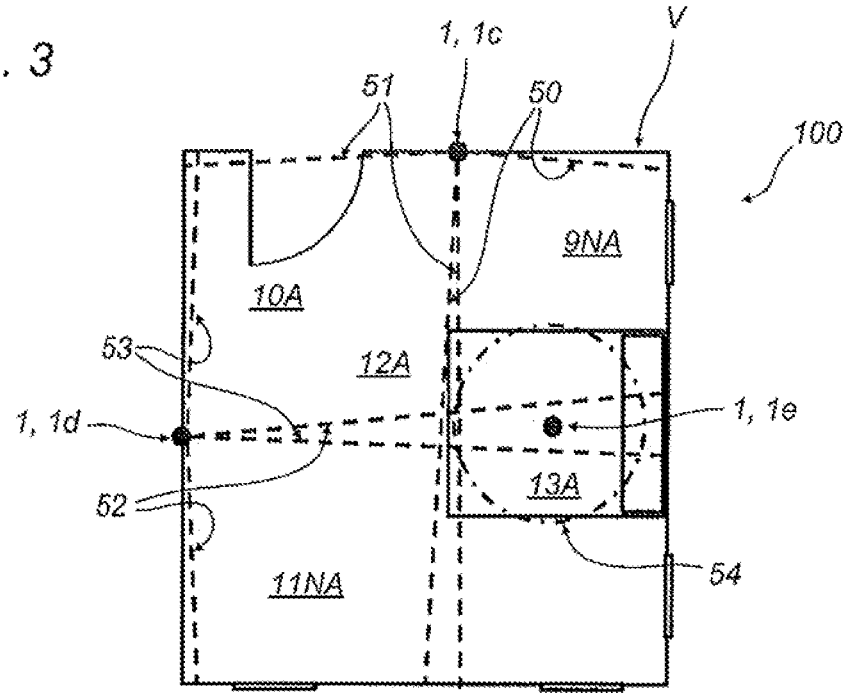
FIG. 3 shows yet another application example of the monitoring device and system according to this invention.

With regard to FIG. 3, attention is drawn to the following.

The figure shows a monitoring system 100 for an environment having a more complex shape than those shown in FIGS. 1 and 2.

It should be noted that the example in FIG. 3 shows three monitoring devices (1*c*, 1*d*, 1*e*), interconnected with each other.

Preferably, the devices 1*c*, 1*d* are fixed to vertical walls and the device 1*e* is fixed to an upper horizontal wall.

The first device 1*c* detects the movement in a first authorised space 10A (edges 51) and in a second unauthorised space 9NA (edges 50).

The second device 1*d* detects the movement in the spaces having as edges 52 and 53: the space with edges 52 is an unauthorised space 11NA, whilst the space with edges 53 is the authorised space 12A.

A third device 1*e* detects the movement in the space having as edges 54 (circular area).

The space having as edges 54 is an authorised space 13A and its purpose is such that the monitoring system considers certain spaces located inside unauthorised spaces (in the specific example, the space 13A is fully contained in the space 9NA and a portion of the same volume 13A is contained in the space 11NA) as authorised spaces.

It is worthwhile adopting this configuration where there are zones in which persons can stay still (for longer than the time-out time) and in which, implementing the method described above, there would be the risk of false alarms due to movements of persons in unauthorised spaces at the time of their movement following a stop (usually in zones where there is a seat, a sofa etc.).

For example, the situation described above is the one relative to a person who stops (that is, stops moving) in an unauthorised space and starts the movement again after a time greater than the duration of the time-out (after which, the algorithm has set the status variable as "unoccupied").

The configuration described above, in which authorised spaces 13A are created inside unauthorised spaces 11A, allows the above-mentioned problem to be resolved.

The control unit of the monitoring system 100, in this application example, uses the signals of the various devices and keeps synchronised the detection devices so as to provide the correct time sequence of the events transmitted by the devices, to activate or not the alarm.

Advantageously, in the case of buildings but more in general for any type of zone monitored, the device 1 can be kept active also in the presence of persons in the zone subject to monitoring: the operational logic of the device 1 allows authorised persons in the area to be distinguished from unauthorised persons, for which the alarm should be activated.

It should therefore be noted that the device 1, the system 100 and the monitoring method allow the problems highlighted with regard to prior art volumetric safety systems, which could have been kept active only if there were no persons present in the zone subject to monitoring, to be resolved.

The invention described above is susceptible of industrial application and may be modified and adapted in several ways without thereby departing from the scope of the inventive concept. Moreover all the details of the invention may be substituted for technically equivalent elements.

The invention claimed is:

1. A method for monitoring a predetermined space, comprising:

a) using at least one first volumetric sensor for detecting whether there has been a movement in an authorized zone of said space and outputting a first movement signal when there has been a movement in the authorized zone;

b) using at least one second volumetric sensor for detecting whether there has been a movement in an unauthorized zone of said space and outputting a second movement signal when there has been a movement in the unauthorized zone;

c) determining whether the first movement signal or the second movement signal has been output;

d1) instructing a status variable to adopt a first value if either the first movement signal or the second movement signal has been output, indicative of a presence of at least one person in said space, and to adopt a second value if neither of the first movement signal or the second movement signal has been output, indicative of an absence of persons in said space;

d2) if said status variable has the first value, activating a countdown;

d3) detecting a further movement in either of the authorized zone or the unauthorized zone;

e) if said status variable has said second value and said further movement was detected in said unauthorized zone, making an alarm indication;

f) if said status variable has said second value and said further movement was detected in the authorized zone, setting the status variable to the first value and activating the countdown;

g) if said status variable has said first value and the further movement was detected either in the authorized zone or in the unauthorized zone, resetting and reactivating the countdown;

h) if the countdown has finished without detection of the further movement in either the authorized zone or the unauthorized zone, setting the status variable to the second value.

2. The method according to claim 1, wherein said authorized zone at least partly overlaps with the unauthorized zone and in said step e) an alarm indication is made if said status variable has said second value and said movement was initially detected only in said unauthorized zone.

3. The method according to claim 1, comprising an initialization step, before the steps from c) to h), in which said status variable is set:

to the first value if a movement is detected within said space for a predetermined time;

to the second value if no movement is detected within said space for a predetermined time.

4. The method according to claim 1, wherein said authorized zone comprises at least one portion which is completely inside said unauthorized zone.

5. The method according to claim 1, wherein the determining step c) comprises a step of analyzing peaks of the signals of the sensors for identifying a movement in said space.

6. The method according to claim 1, wherein said space is an environment inside a building and said unauthorized zone is positioned in such a way that it comprises openings in communication with an outside of the environment.

7. A device for monitoring a predetermined space, comprising:

at least one first volumetric sensor detecting whether there has been a movement in an authorized zone of said space and outputting a first movement signal when there has been a movement in the authorized zone;

at least one second volumetric sensor detecting whether there has been a movement in an unauthorized zone of said space and outputting a second movement signal when there has been a movement in the unauthorized zone;

a processor programmed to:

determine whether the first movement signal or the second movement signal has been output;

instruct a status variable to adopt a first value if either the first movement signal or the second movement signal has been output, indicative of a presence of at least one person in said space, and to adopt a second value if neither of the first movement signal or the second movement signal has been output, indicative of an absence of persons in said space;

if the status variable has the first value, activate a countdown;

detect a further movement in either of the authorized zone or the unauthorized zone;

if said status variable has said second value and said further movement was detected in said unauthorized zone, make an alarm indication;

if said status variable has said second value and said further movement was detected in the authorized zone, set the status variable to the first value and activate the countdown;

if said status variable has said first value and the further movement was detected either in the authorized zone or in the unauthorized zone, reset and reactivate the countdown;

if the countdown has finished without detection of the further movement in either the authorized zone or the unauthorized zone, set the status variable to the second value.

8. The device according to claim 7, wherein each of the sensors comprises a mirror optic.

9. The device according to claim 7, wherein said sensors and said processor are integrated in a same box-shaped container.

10. A system for monitoring a predetermined area, comprising:

a plurality of devices according to claim 7;

a control unit, connected to each device for receiving said alarm indication and activating an alarm depending on values of said alarm indications;

said alarm, connected to and activated by the control unit.

11. The method according to claim 1, and further comprising withholding the alarm indication if there has been the further movement, if said status variable has said second value and said further movement was initially detected in the authorized zone.

12. The method according to claim 1, and further comprising withholding the alarm indication if there has been the further movement, if said status variable has said first value.

* * * * *